US005522157A

United States Patent [19]

Howey et al.

[11] Patent Number: 5,522,157

[45] Date of Patent: Jun. 4, 1996

[54] APPARATUS AND METHOD FOR DRYING STACKS OF SHEET MATERIAL

[75] Inventors: Michael A. Howey; Eric M. Leonard; Michael Long, all of Rochester; James A. White, Conesus, all of N.Y.

[73] Assignee: Eastman Kodak Company, Rochester, N.Y.

[21] Appl. No.: 321,277

[22] Filed: Oct. 11, 1994

[51] Int. Cl.[6] ..... F26B 3/00; B30B 3/00

[52] U.S. Cl. ..... 34/460; 34/463; 34/388; 100/153; 100/210

[58] Field of Search ..... 34/614, 639, 653, 34/655, 656, 388, 463, 460; 100/92, 74, 153, 210

[56] References Cited

U.S. PATENT DOCUMENTS

| | | | |
|---|---|---|---|
| 1,552,099 | 9/1925 | Walsh | 34/463 X |
| 1,743,921 | 1/1930 | Kerley . | |
| 2,255,859 | 9/1941 | Quigley | 34/639 X |
| 2,626,801 | 1/1953 | Uriell | 271/81 |
| 3,159,398 | 12/1964 | Buccicone | 271/68 |
| 3,324,571 | 6/1967 | Stock | 34/653 |
| 3,656,743 | 4/1972 | Ruud | 34/614 X |
| 3,724,089 | 4/1973 | Thompson et al. | 34/23 |
| 3,737,051 | 6/1973 | Horino | 214/6 |
| 3,815,259 | 6/1974 | Atwood et al. | 34/150 |
| 3,823,028 | 7/1974 | Arian et al. | 34/614 X |
| 3,939,000 | 2/1976 | Arvidson, Jr. et al. | 96/87 |
| 3,945,095 | 3/1976 | Herold et al. | 271/210 |
| 3,977,670 | 8/1976 | Tsuruta et al. | 271/207 |
| 4,132,400 | 1/1979 | Naramore | 271/221 |
| 4,624,719 | 11/1986 | Volbel et al. | 100/153 X |
| 5,061,611 | 10/1991 | Sakata et al. | 430/533 |
| 5,096,803 | 3/1992 | Kanetake et al. | 430/349 |
| 5,295,309 | 3/1994 | Kozlowski et al. | 34/23 |

*Primary Examiner*—Hoang Nguyen
*Attorney, Agent, or Firm*—Arthur H. Rosenstein

[57] ABSTRACT

Stacks (16) of sheet material are moved on a conveyor (12, 14) between air manifolds (18, 20) and guide pins (19, 21); so that, drying gas is directed between the sheets of the stacks to cause the stacks to expand to form fluffed stacks 28 through which air moves readily to dry the sheets. A compression roller (26) is used to expel air from the fluffed stack and return the stack essentially to its original height. A reduction in tendency to curl is achieved in low relative humidity environments for sheets of photographic film.

37 Claims, 11 Drawing Sheets

APPARATUS AND METHOD FOR DRYING STACKS OF SHEET MATERIAL

TECHNICAL FIELD

The invention concerns apparatus and a method for drying sheet material. More particularly, the invention relates to techniques for drying previously formed stacks of sheet material, such as stacks of sheets of photographic film or paper which have been manufactured at about 50% relative humidity to control build up of triboelectric charge.

BACKGROUND ART

Equipment for handling or processing X-ray film over the years has been improved to transport and process film sheets at ever faster rates. Due to this requirement for high speed operation, the flatness of the individual sheets has become more important during transporting and processing. This is because the sheets encounter various equipment features such as fixed height edge guides, nip conveyance rollers, suction cup handling devices and the like which depend to greater or lesser degrees on the presence of sheets of good flatness. Similar requirements for flatness are found in transporting and handling equipment for other sheet materials, such as photographic paper, copier paper and the like. X-ray film sheets and other sheet materials under certain conditions may exhibit a longitudinal or transverse curl which can interfere with movement of the sheets through the equipment. The curl can be particularly acute if the ambient atmosphere of the equipment has a relative humidity which is substantially lower than that to which the sheets were equilibrated prior to hermetic packaging. In such a case, the layers of photosensitive materials on the upper side of the sheet tend to equilibrate with the conditions in the equipment at a different rate than the layers on the underside of the sheet. This differential response leads to formation of the undesirable curl, which may cause the edges of the sheets to lift as much as a few sixteenths of an inch (0.159 cm) or more.

Various techniques have been tried for improving the dimensional stability of photographic film sheets during changes in ambient relative humidity. Latex polymers have been added to the layers of photosensitive materials. Master rolls of film base and completed film have been subjected to long and complex heat treatment procedures to reduce their tendencies to curl. Hydrophobic layers have been added to the films to reduce their tendency to absorb or release moisture. While these techniques have provided certain improvements in performance, the problem of curl has persisted for sheets of film. A need has existed for a simple, reliable way to dry film sheets to an appropriate degree prior to packaging.

SUMMARY OF THE INVENTION

Our invention is defined by the claims. We have learned that the tendency for film sheets to curl can be minimized if the moisture content of the sheets at the time of packaging can be reduced to levels more nearly approximating those to be encountered in the sheet handling equipment. Broadly speaking, our invention concerns apparatus and a method for drying previously formed stacks or packs of sheets of X-ray photographic film, the stacks having for instance as many as 100 sheets. Stacks of photographic paper and other sheet materials also may be dried using our invention. Drying to a moisture content suitable for packaging is achieved by blowing low relative humidity air first against one side of the stack and then against the other; so that, the air flows between the individual sheets of a stack and the stack is fluffed or expanded to a multiple of its original height, while the stack is conveyed though an enclosing tunnel. The individual sheets are thus dried, after which the stack is compressed to its original height prior to packaging. As a result of the reduction of moisture in the stack prior to packaging, the dimensional stability of the sheets of film is improved, thereby enhancing their performance in automated sheet handling equipment.

One embodiment of our method is particularly suited for essentially uniformly drying a stack of sheet material, such as sheets of photographic film or paper, the stack having a width; a length; a height; first and second opposite sides separated by the width, to which sides opposite side edges of each sheet extend; and a front side and a rear side separated by the length. A first flow of a drying gas such as air is directed against the edges substantially along the length and height of the first side to cause the drying gas to flow rather uniformly between the individual sheets across the width toward the second side. By "substantially along the length and height of (a) side" is meant that during the practice of our method, the drying gas impinges for a period of time on substantially the entire side wall area of the stack. As a result, the stack expands or fluffs to a height in the range of two to three times its original height. A second flow of drying gas then is directed against the edges substantially along the length and height of the second side to cause the drying gas to flow rather uniformly between the individual sheets across the width toward the first side. The first flow may be terminated prior to commencing the second flow. The second flow is then terminated. To force the drying gas to flow from the first side toward the second and vice versa, flow of the drying gas from the front and rear sides of the pack is impeded while drying gas is flowing from side to side. After drying in this manner, the stack is compressed to expel gas from between the sheets and return the stack essentially to its original height. The stack may be conveyed continuously or intermittently along a path while flows of gas are directed alternately at its opposite sides.

One embodiment of the apparatus of our invention comprises a source of drying gas and a first flow guide member connected to the source to direct a first flow of drying gas against the edges of the stack of sheets, substantially along the length and height of the first side, to cause the drying gas to flow between the sheets across the width toward the second side. A second flow guide member is connected to the source to direct a second flow of drying gas against the edges, substantially along the length and height of the second side, to cause the drying gas to flow between the sheets across the width toward the first side. Means, such as a conventional programmable controller, are provided for terminating the first flow prior to terminating the second flow; and for terminating the second flow. The first flow may be terminated before the second flow commences. Baffles may be provided for impeding flow of the drying gas from the front and rear sides. Means may be provided for compressing the stack after terminating the second flow to expel drying gas from between the sheets. A conveyor may be provided for moving the stack along a path between the first and second flow guide members. An enclosure may be provided for surrounding the first and second flow guide members while a stack is being dried.

Our invention provides numerous advantages. Individual sheets in a stack are essentially uniformly dried during conveying; so that, their moisture content is reduced by as much as 15%. As a result, the tendency of sheets to curl, when unpackaged and place in sheet transporting and handling equipment, is reduced substantially. Thus, jamming and similar malfunctions attributable to curl are minimized, particularly for applications of the sheets in environments with low relative humidity. Rapid drying is achieved without build up of static charge. Multiple stacks of sheets may be dried in a continuous process.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
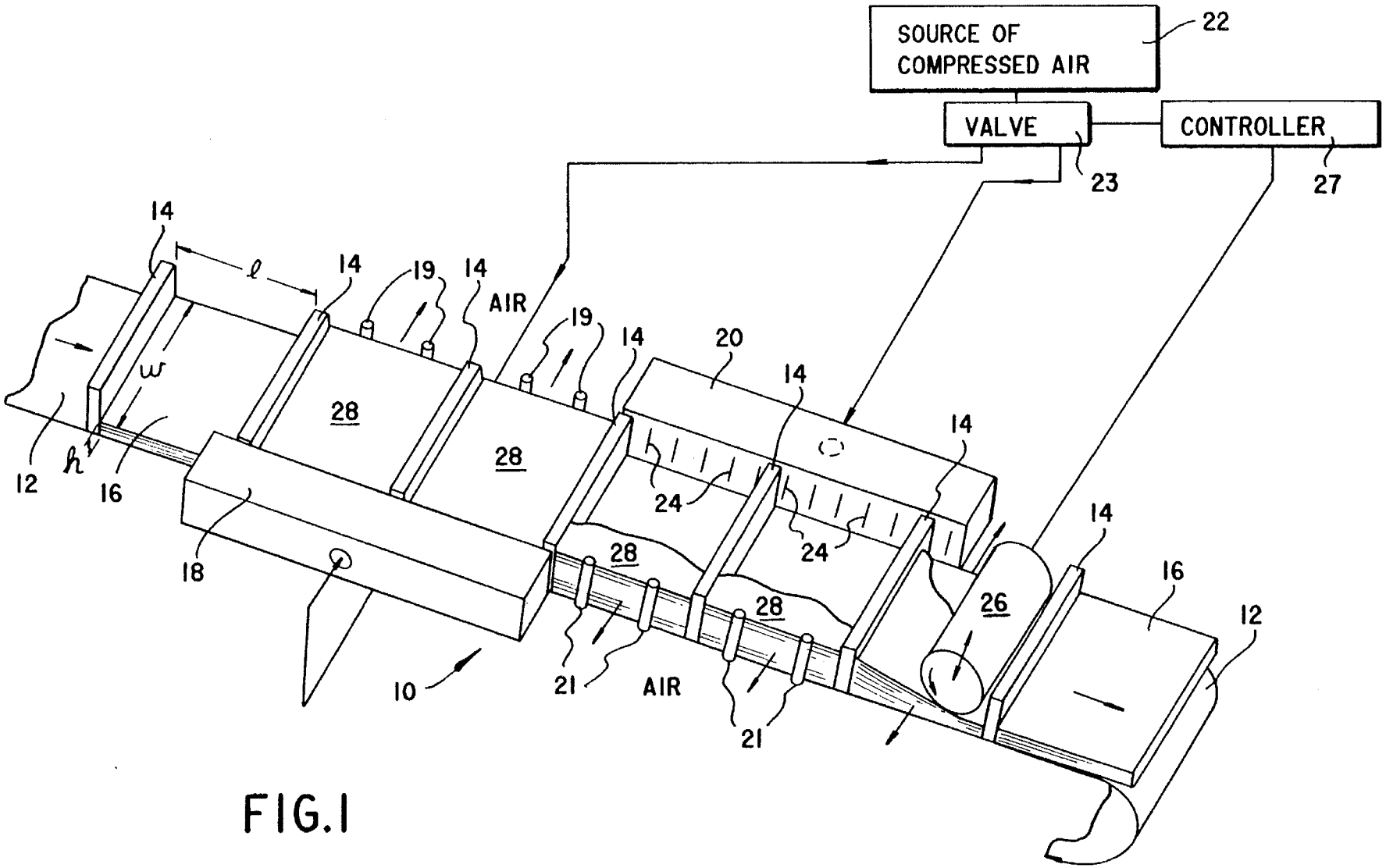
FIG. 1 illustrates schematically a fragmentary, perspective view of an apparatus according to our invention.

The following is a detailed description of the preferred embodiments of the invention, reference being made to the drawings in which the same reference numerals identify the same elements of structure in each of the several Figures.

Overall Structure and Operation

FIG. 1 shows schematically an apparatus 10 embodying the primary features of our apparatus and operating in accordance with our method. A conventional conveyor 12, which preferably is essentially horizontal, comprises a belt or link belt on which are mounted a plurality of transverse flights or paddles 14 evenly spaced along the length of the belt in the familiar manner. The width of the belt and the spacing between paddles 14 are chosen to be only slightly larger, respectively, than the width w and the length l of a pack or stack 16 of sheet material, such as sheets of photographic paper or film. A clearance of about 0.063 inch (1.59 mm) is suitable. The height of paddles 14 is chosen to be approximately three times the compressed height h of each stack 16, for a purpose to be discussed shortly. Prior to being placed on conveyor 12, sheets of material are assembled into essentially regular parallelepiped stacks 16 whose front and rear sides, separated by length l, face paddles 14; and whose opposite sides, separated by width w, face outwardly from conveyor 12.

As shown in FIGS. 2A, 2B, 3A, 3B and 4, at least the upper span of conveyor 12 is covered by a housing or tunnel not illustrated in FIG. 1. In the following description references to right- and left-hand sides of the apparatus are made with reference to a view along conveyor 12 in the direction of movement indicated by the arrows in FIG. 1. Within such a tunnel, stacks 16 on conveyor 12 move initially between and past a right-hand, elongated drying air manifold or flow guide member 18 and a left-hand line of guide pins or blocks 19 opposite manifold 18. Stacks 16 then move between and past a left-hand, elongated drying air manifold 20 and a right-hand line of guide pins or blocks 21 opposite manifold 20. In a preferred embodiment of our invention, manifolds 18 and 20 are positioned so that their ends do not overlap; however, use of overlapping manifolds also is within the scope of our invention. Each of manifolds 18, 20 includes an essentially vertical wall facing conveyor 12 and comprising an array of slits 24 through which drying gas is forced toward stacks 16. The spacings between manifolds 18, 20 and guide pins 19, 21, respectively, are chosen to be only slightly larger than width w. A clearance of about 0.063 inch (1.59 mm) on each side is suitable. However, as shown in the Figures, space is provided behind the guide pins to permit the drying air to flow away from the conveyor. The drying gas may be provided from a conventional source 22 of compressed air having an appropriate relative humidity and temperature. To assist with static control, a source of deionized air may be use. A conventional pneumatic control valve 23 may be used to direct air to either or both of manifolds 18, 20 under the control of a conventional, programmable controller 27.

In operation of the apparatus thus far described, conveyor 12 is operated by controller 27 to move stacks 16 continuously between the manifolds and guide pins. As each stack passes manifold 18, drying air issuing from slits 24 engages one side of the stack and flows between the sheets toward the opposite side where the air exits between guide pins 19. The small clearances between the stack, paddles 14 and the surrounding tunnel or housing impede flow of drying air except in the direction across the conveyor between the sheets of the stack. Due to the passage of the drying air, the stack fluffs or expands upward between paddles 14 to form an expanded stack 28 as the sheets are separated by the air. The upward expansion of the stack is limited by paddles 14 and the surrounding tunnel or housing, to a height some two to three times the initial, compressed height h. The maximum height of the expanded stack is chosen to avoid undue vibrations or undulations of the individual sheets, which may occur as the stack height increases. The appropriate height for a given expanded stack can be determined readily. Moisture is removed from the sheets. As the front or leading side of the stack moves past the downstream end of manifold 18, flow of air from manifold 20 engages the opposite side of the stack and flows between the sheets, eventually exiting between guide pins 21. For a period of time, the stack is subjected to flows of drying air from both of manifolds 18, 20; and thereafter, the stack receives air only from manifold 20. Additional moisture is removed from the sheets. The lengths of manifolds 18, 20 depend on the size of the stacks to be dried and may be determined readily for a given stack size. As the front side of the stack moves past the downstream end of manifold 20, controller 27 lowers a compression roller 26 onto the top of the stack to compress the stack and expel the drying air, thereby essentially returning the stack to its original height h.

Those skilled in the art will appreciate that manifolds 18, 20 could be spaced along conveyor 12 by more than a stack length, without departing from the spirit of our invention. In such a case, flow into the stack from manifold 18 would terminate completely before flow commences from manifold 20. Also, additional pairs of manifolds could be included to subject each stack to further, alternating flows of drying air. Though continuous operation is advantageous, the apparatus could also be operated intermittently with each successive stack stopping briefly before each manifold for fluffing and drying.

Detailed Description of One Embodiment

Figure 2A:
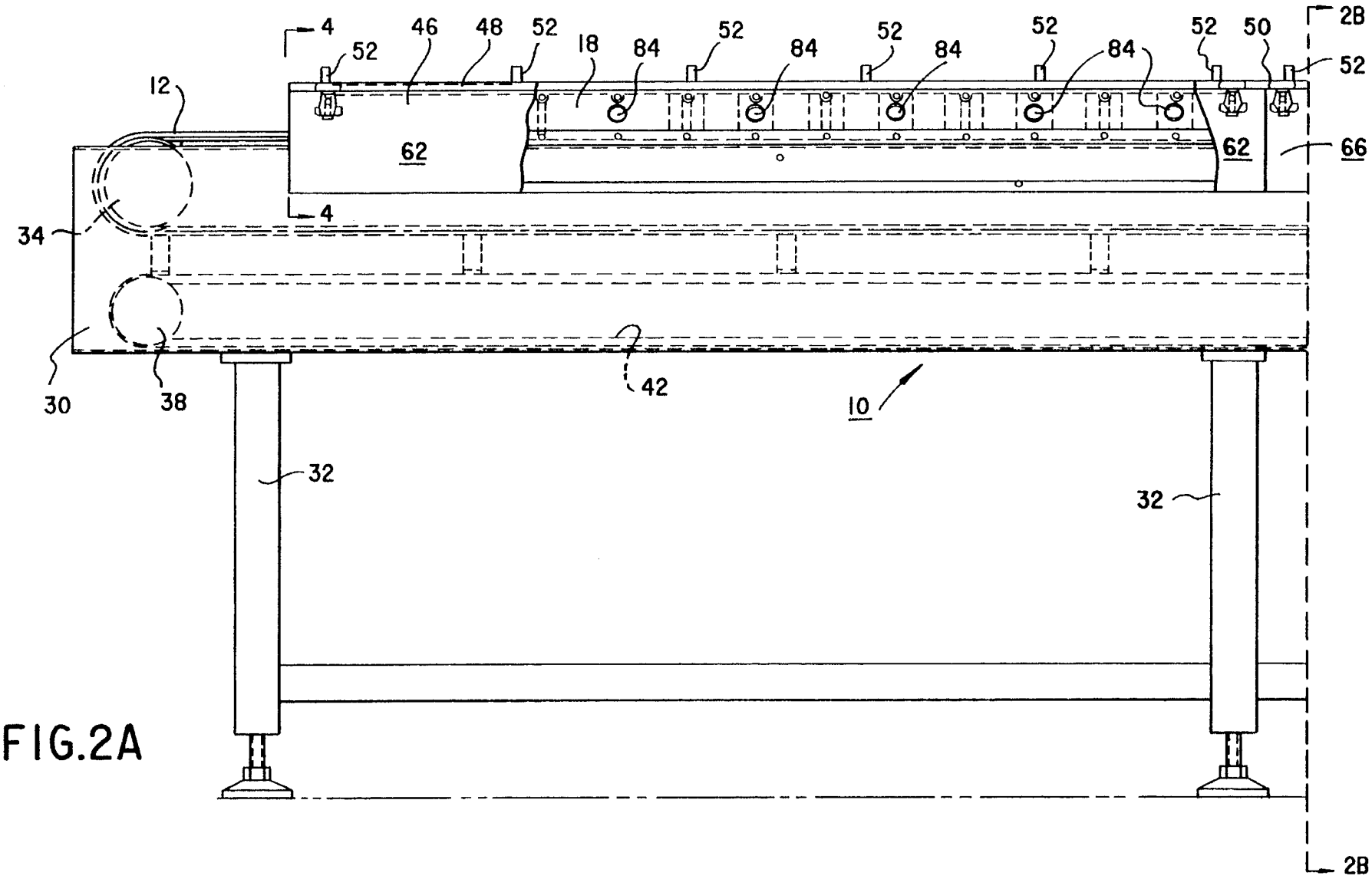
FIGS. 2A and 2B, when laid end to end along lines 2A—2A and 2B—2B, illustrate an elevation view, partially broken away, of an apparatus according to our invention.

Turning now to FIGS. 2A to 11, the details of one embodiment of our invention may be understood. The apparatus comprises a rigid box frame 30 supported on a plurality of legs 32. At the infeed end of the apparatus, on the left as seen in FIG. 2A, a trio of sprockets 34 are rotatably mounted to support one end of the belt of conveyor 12. At the outfeed end, on the right as seen in FIG. 2B, a similar trio of sprockets 36 supports the other end of the belt. Beneath conveyor 12, spaced sprocket pairs 38 and 40, one of which may be driven by means not illustrated, are provided to drive and guide a support conveyor 42 on which paddles 14 ride as they move from the outfeed end back toward the infeed end of conveyor 12.

The upper span of conveyor 12 is covered by a tunnel or housing which extends along most of the length of the conveyor, particularly covering manifolds 18, 20. The tunnel comprises a left side wall 44 and a right side wall 46, best seen in FIGS. 2A to 4. Hinged to side wall 44 are an upstream cover plate 48 and a downstream cover plate 50. For ease of observation and maintenance, the walls and cover plates may be made from a transparent plastic material. A plurality of stiffener ribs 52 extend across the upper surfaces of cover plates 50, 52. As seen in FIG. 4, the undersides of cover plates 48, 50 are provided with three rows of spacer blocks 51 spaced along the length of the cover plates. Attached to the undersides of each row of the spacer blocks is a retainer strip 53 which limits the upward movement of the sheets. The open spaces between the blocks permit the pressure above the expanded stacks to equilibrate essentially to atmospheric pressure. This equilibration tends to minimize vertical oscillation of the expanded stack. Paddles 14 extend close to the under sides of retainer strips 53, a clearance of about 0.063 inch (1.59 mm) being suitable.

Figure 9:
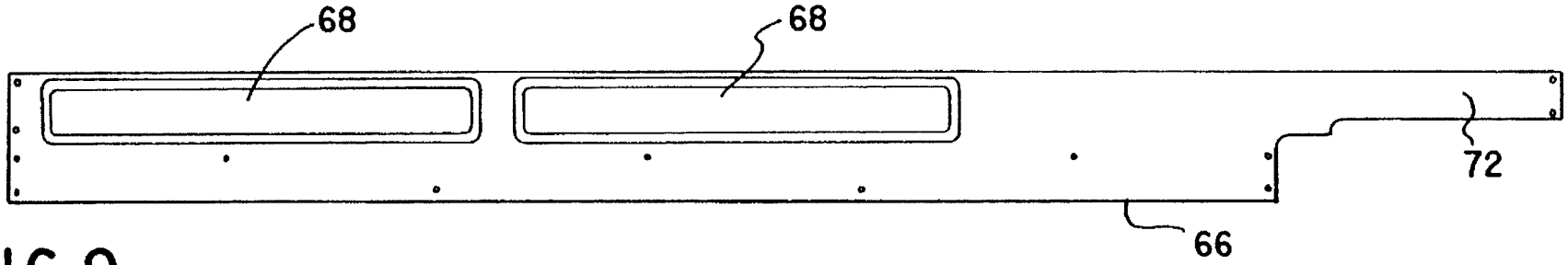
FIG. 9 illustrates an elevation view of a right-hand, downstream air baffle plate used in the apparatus.
Figure 10:
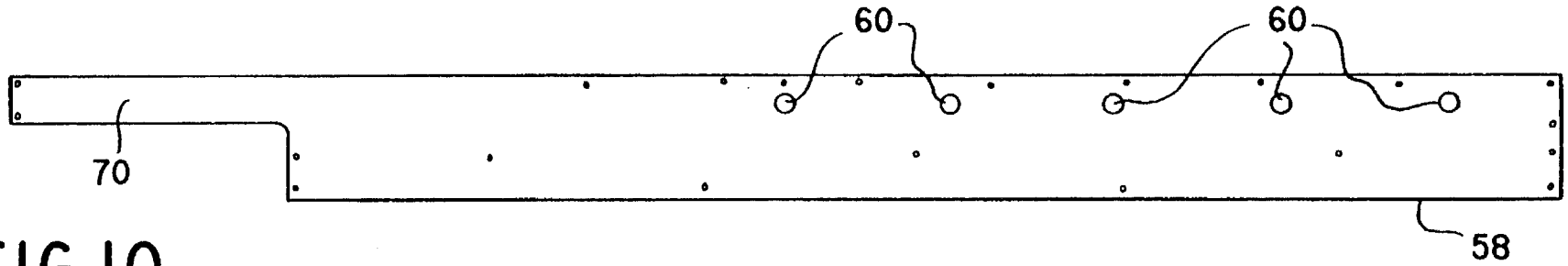
FIG. 10 illustrates an elevation view of a left-hand, downstream side plate used in the apparatus.
Figure 11:
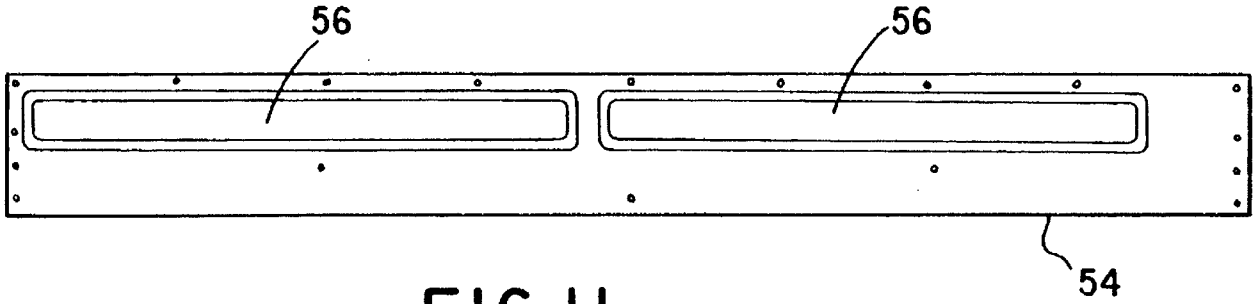
FIG. 11 illustrates an elevation view of a left-hand, upstream air baffle plate used in the apparatus.

As shown in detail in FIG. 11, side wall 44 comprises at its upstream end an air baffle plate 54 having a pair of elongated apertures 56 in which air dampening filters such as porous plastic plates, not illustrated, are mounted to exhaust the flow of air coming from manifold 18 and passing guide pins 19. As shown in FIGS. 2A to 4, at its downstream end side wall 44 is comprised, as shown in FIG. 10, a side plate 58 having a plurality of ports 60 through which air conduits, not illustrated, are extended from source 22 to manifold 20. As shown in detail in FIG. 8, side wall 46 comprises at its upstream end a side plate 62 having a plurality of ports 64 through which air conduits, not illustrated, are extended from source 22 to manifold 18. As shown in FIG. 9, at its downstream end side wall 46 comprises an air baffle plate 66 having a pair of elongated apertures 68 in which air dampening filters, not illustrated, are mounted to exhaust the flow of air coming from manifold 20 and passing guide pins 21. Extensions 70, 72 complete the downstream ends of plates 58, 66. At the outfeed end of conveyor 12, a raised cover 74 is provided downstream of cover plate 50 and above compression roller 26.

Within the tunnel defined by the side walls and cover plates, each of manifolds 18, 20 comprises, as shown in FIG. 4 to 7, an elongated, rectangular body 76 which encloses a plurality of interior gas distribution plenums 78 separated by interior walls 80. A cover plate 82 closes plenums 78 and includes a plurality of openings 84, one positioned opposite each of ports 60, 64. The face of body 76 facing conveyor 12 comprises an array of vertically extending air exhaust slits 86, four for each of plenums 80. Also within the tunnel, left and right elongated support plates 90, 92, best seen in FIGS. 3A to 4, are attached to side walls 44, 46 to provide suitable mounting places for manifolds 18, 20 and guide pins 19, 21.

Beneath raised cover 74, a pair of roller brackets 94 are mounted to support plates 90, 92. Pivotably supported on the brackets are pivot arms 96. A pair of pneumatic cylinders 98 are mounted pivotably between the support plates and the pivot arms. Compression roller 26 is supported between the pivot arms. Upon actuation of cylinders 98 in response to controller 27, roller 26 may be raised to allow a paddle 14 to pass and then lowered to compress the next stack to pass manifold 20.

Figure 2B:
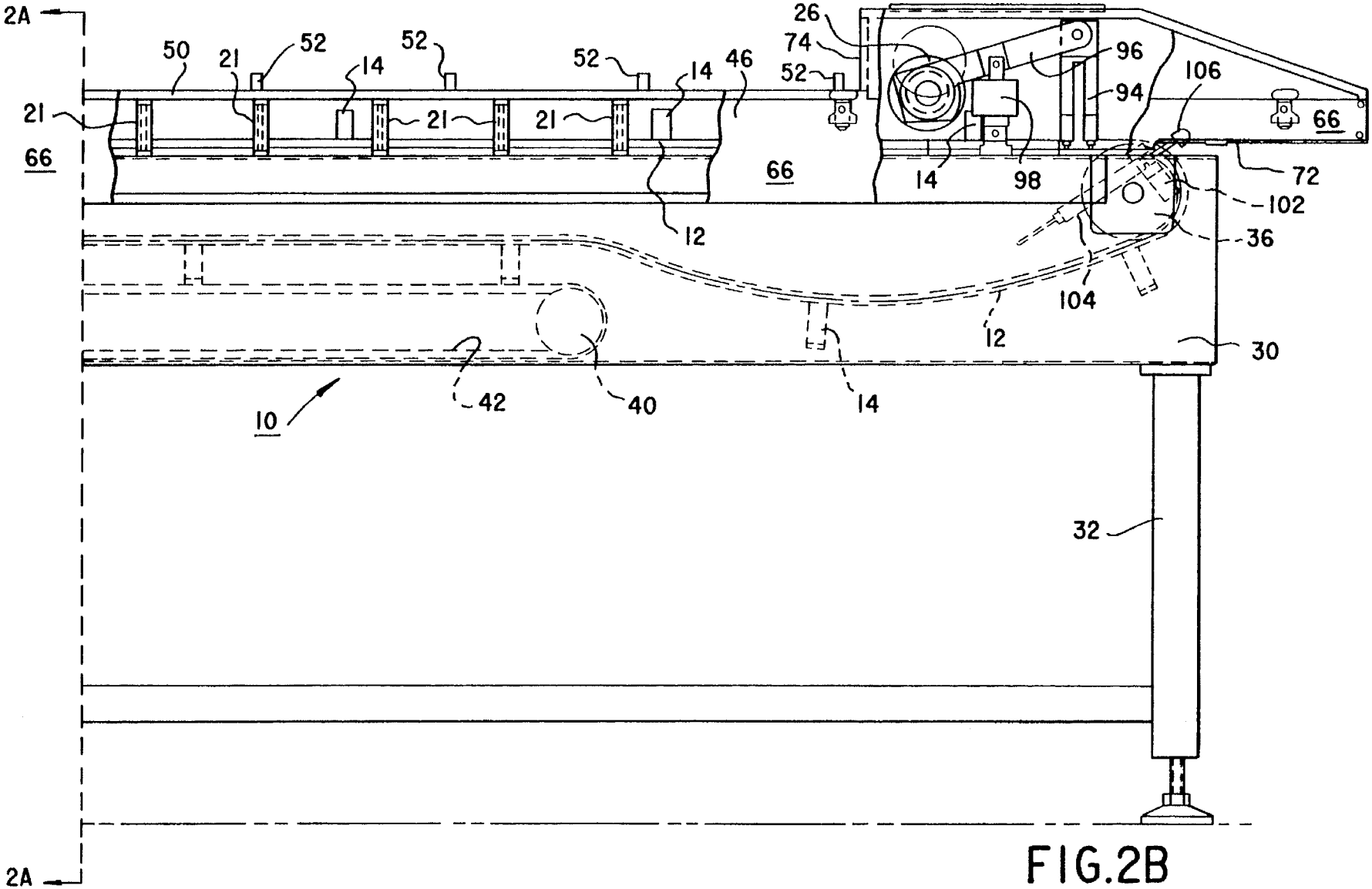
Figure 3A:
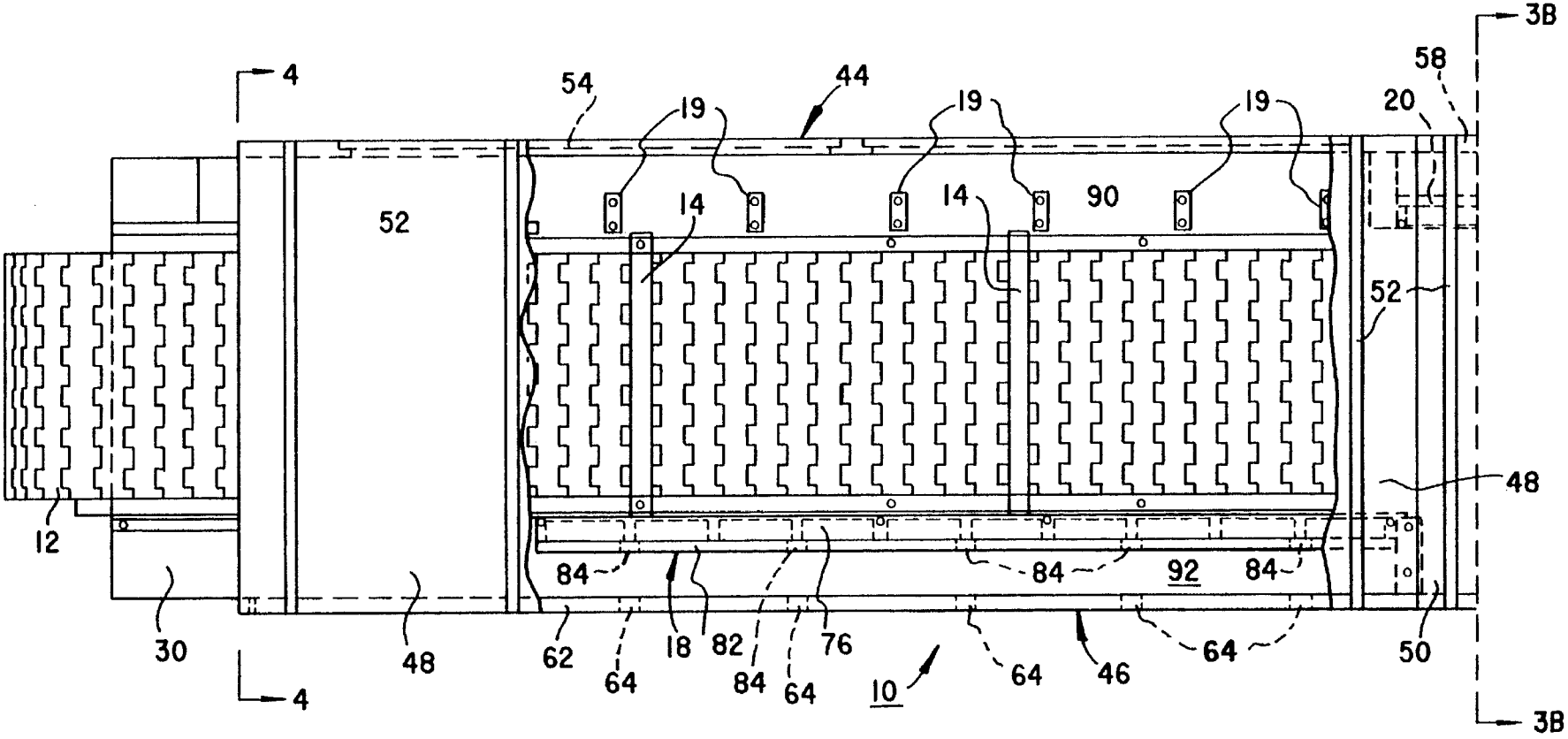
FIGS. 3A and 3B, when laid end to end along lines 3A—3A and 3B—3B, illustrate a plan view, partially broken away, of the apparatus of FIGS. 2A and 2B.
Figure 3B:
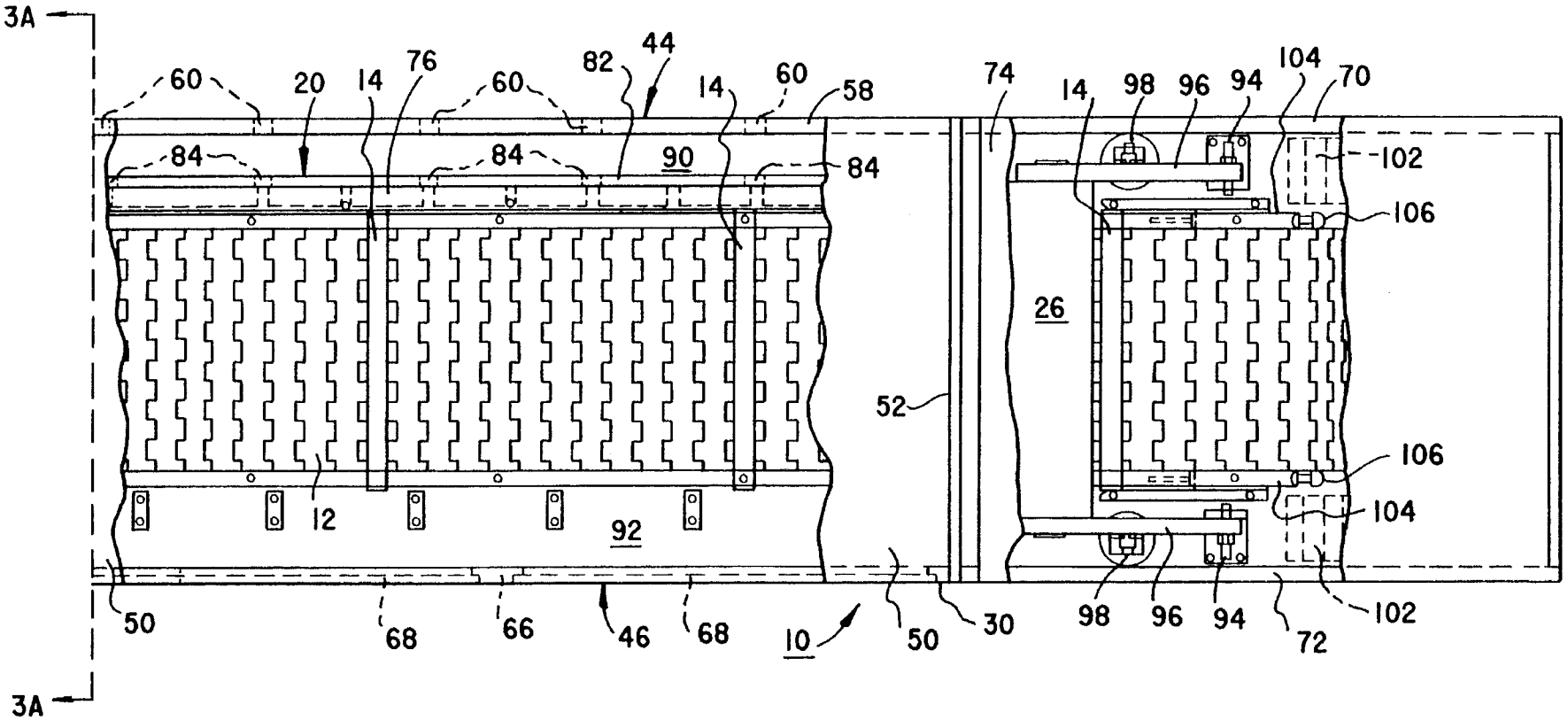
Figure 4:
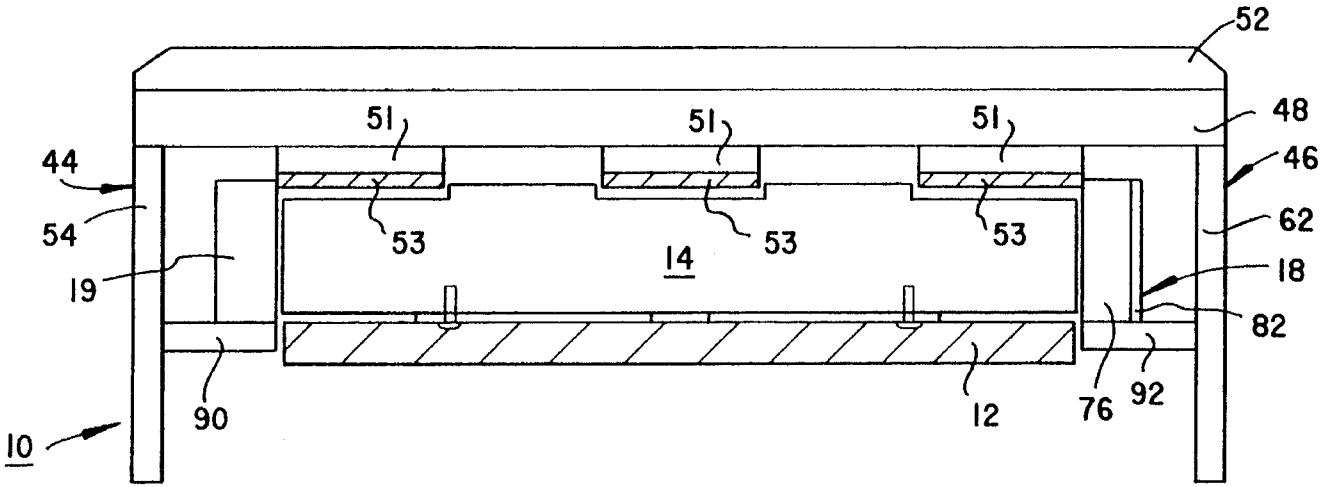
FIG. 4 illustrates a view along line 4—4 of FIGS. 2A and 3A.
Figure 5:
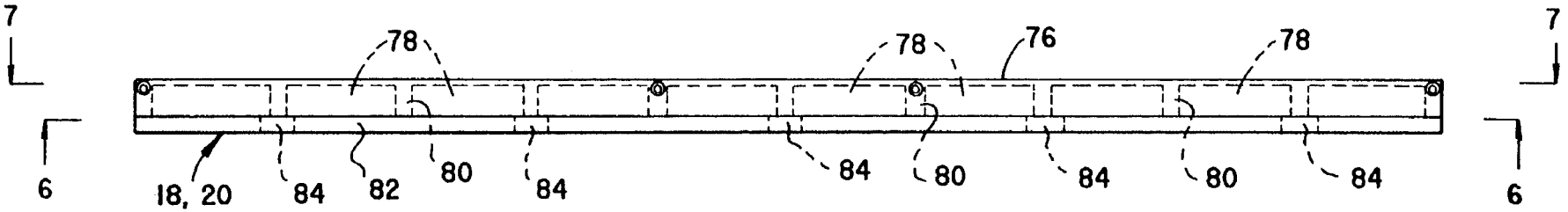
FIG. 5 illustrates a plan view of a drying gas manifold or flow guide member used in the apparatus.
Figure 6:
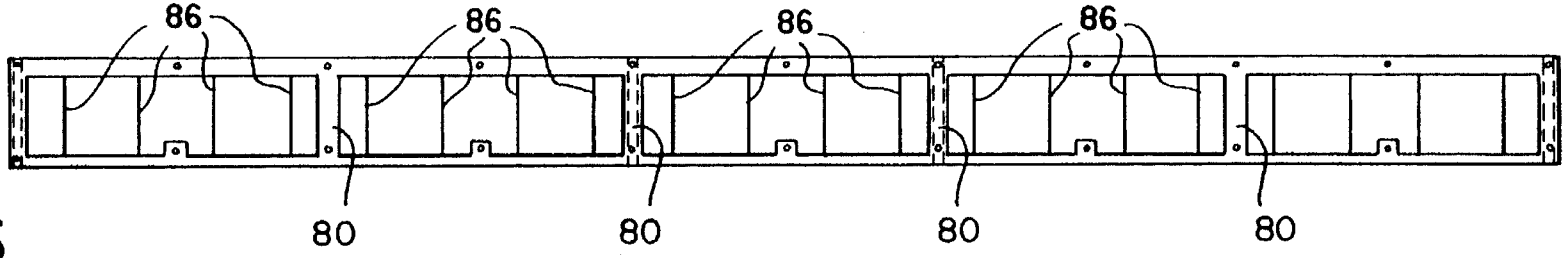
FIG. 6 illustrates a view along line 6—6 of FIG. 5 into the interior of the drying gas manifold.
Figure 7:
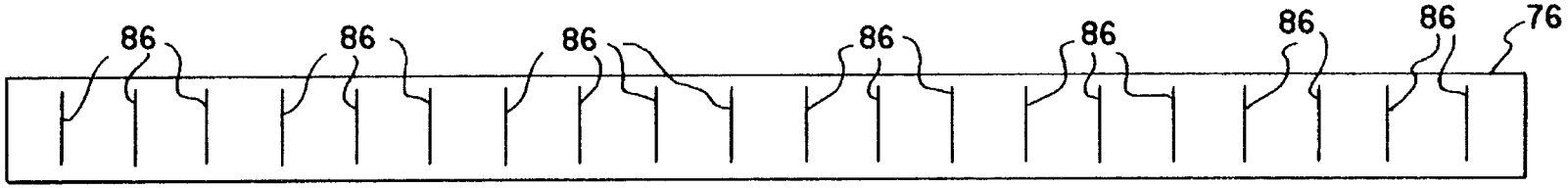
FIG. 7 illustrates a view along line 7—7 of FIG. 5 of the face of the drying gas manifold through which are provided slits for drying gas.
Figure 8:
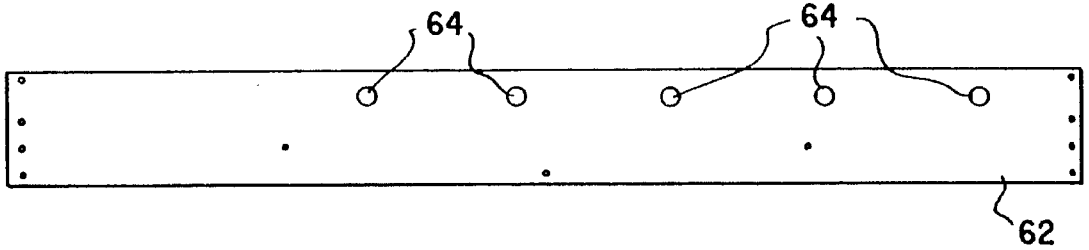
FIG. 8 illustrates an elevation view of a right-hand, upstream side plate used in the apparatus.

As shown largely in phantom lines in FIGS. 2B and 3B, means are provided beneath cover 74 for guiding each stack as it moves from conveyor 12 onto an outfeed table or conveyor, not illustrated. A pair of cylinder brackets 102 are mounted on the inside of frame 30 just at the end of conveyor 12. A pair of pneumatic cylinders 104 are mounted on brackets 102 and positioned at the opposite edges of the conveyor. The rod of each cylinder 102 is provided with a lifter finger 106 made from a lubricious material such as Nylon or Teflon. In operation, the rod of each cylinder 102 is extended in response to controller 27 to engage the underside of each stack as the stack begins to extend away from the bed of the conveyor. Due to such engagement by the two lifter fingers, the leading portion of the stack bows somewhat transversely, thereby giving the stack some additional beam strength to prevent its following the conveyor downward and to facilitate its movement from the conveyor onto an adjacent table or further conveyor, not illustrated.

Tests have been conducted for stacks of 100 sheets of X-ray film about 14 by 17 inches (356 by 432 mm) in area with a compressed height of about 0.75 inch (19.05 mm) The initial relative humidity of the stacks was in the range of 37 to 49%. The fluff height was limited to about 2.125 inch (53.98 mm) to avoid unstable movement of the sheets. For such stacks moving past manifolds about 17 inches long at about 4 packs per minute, suitable slits 86 were about 2.0 inches (50.8 mm) high and 0.016 inch (0.406 mm) wide spaced about 2 inches (50.8 mm) apart along body 76. Drying air was passed from source 22 at up to about 7.5% relative humidity, 70° F. (21.1° C.) and 3 to 7 psi (20.69 to 52.54 kPa). Those skilled in the art will appreciate that arrays of holes, other arrangements of slits, porous frits and the like also could be used to provide a flow from the manifolds toward the passing stacks.

After drying in an apparatus configured and operated as described in the preceding paragraphs, the relative humidity of the stack dropped by 12 to 16% relative humidity and tendency to curl was reduced by about one half to two thirds. Lengthening the manifolds or reducing the conveyor speed, or both, would result in still further reductions. Performance of the sheets in sheet handling equipment-improved considerably. No negative effects on the film sheets were observed as a result of being subjected to this drying process.

Other Embodiments

Figure 13:
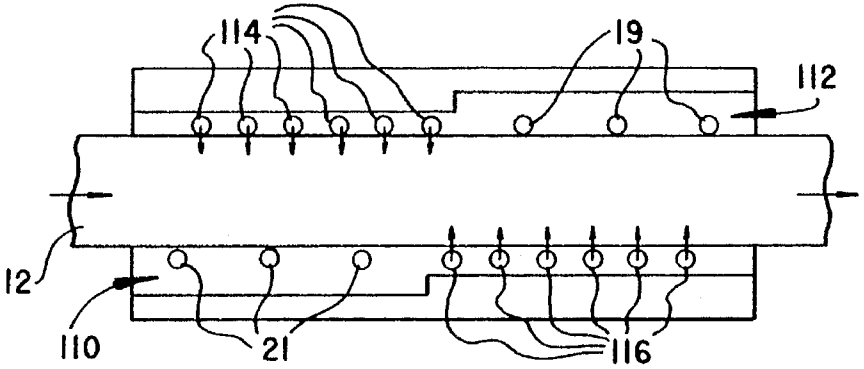
FIGS. 12 to 22 illustrate schematically alternative forms of apparatus suitable for operation in accordance with the method of our invention.
Figure 15:
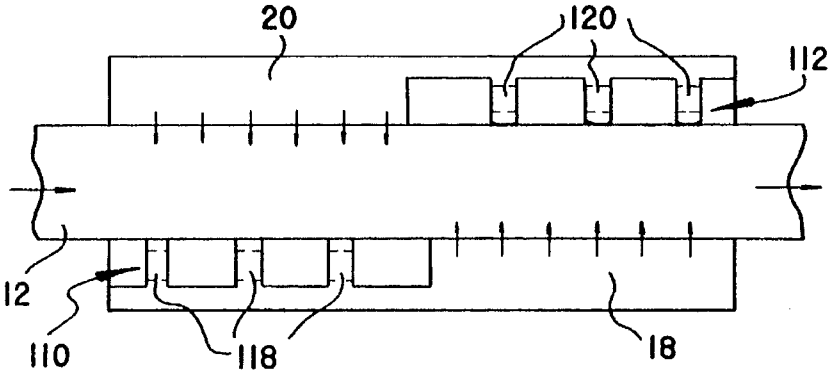
Figure 12:
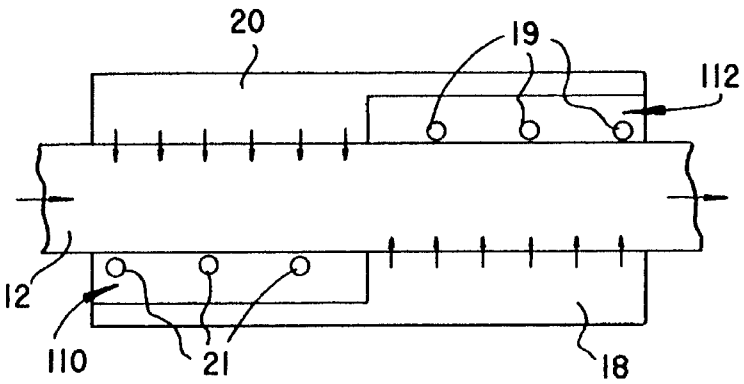
Figure 14:
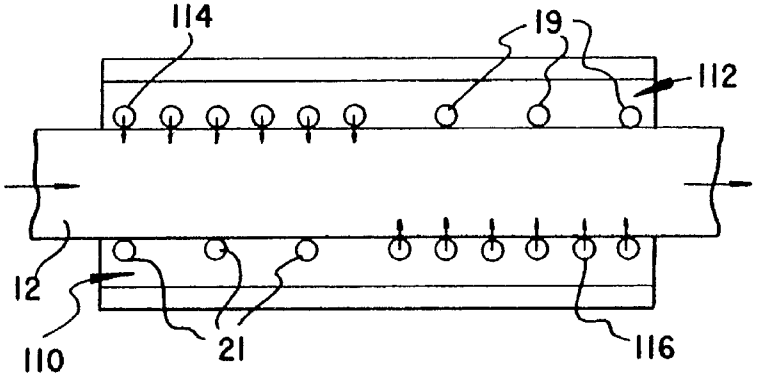
Figure 17:
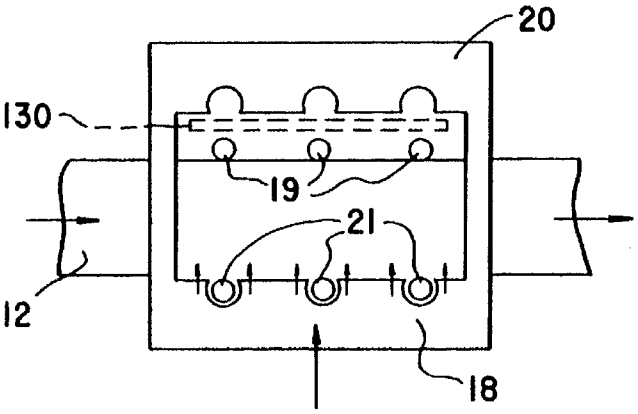
Figure 16:
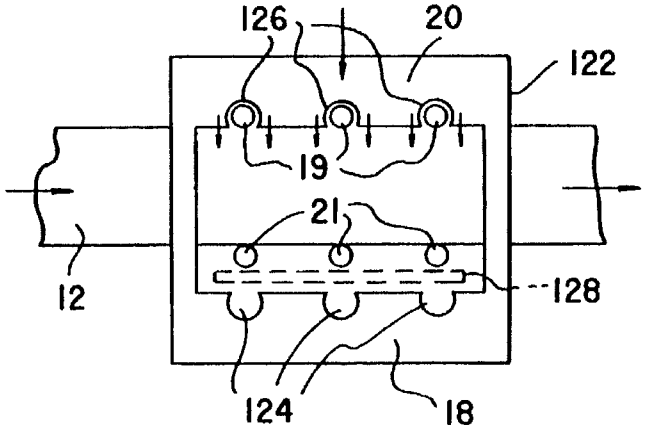

FIGS. 12 to 22 illustrate schematically other embodiments of apparatus which functions in accordance with the method of our invention. In FIG. 12, the operation would be continuous. An exhaust area or plenum 110, 112 is provided behind guide pins 21, 19, respectively; otherwise, the arrangement is much like that already described. In FIG. 13, the operation would be continuous. Manifolds 18, 20 have been replaced by upwardly extended hollow pins 114, 116 which have vertical slits, not illustrated, for directing drying air at the passing stacks. The wall of the tunnel preferably is close behind the hollow pins to optimize their performance. In FIG. 14, the operation would be continuous. Hollow pins 114, 116 are spaced inwardly from the walls of the tunnels, a potentially less efficient arrangement. In FIG. 15, the operation would be continuous. The manifolds include elongated extensions with inward projections 118, 120 which replace the guide pins. To permit flow of air between projections 118, 120, passages may be provided through the projections, as indicated by the dashed lines. In FIGS. 16 and 17, the operation would be intermittent through a short, movable tunnel or hood 122 which would be moved transversely between the positions of FIGS. 16 and 17. Recesses 124, 126 are provided in hood 122 to receive guide pins 19, 21. A pair of exhaust slots 128, 130 on opposite sides of the conveyor are alternately covered and uncovered as the hood is moved back and forth.

Figure 19:
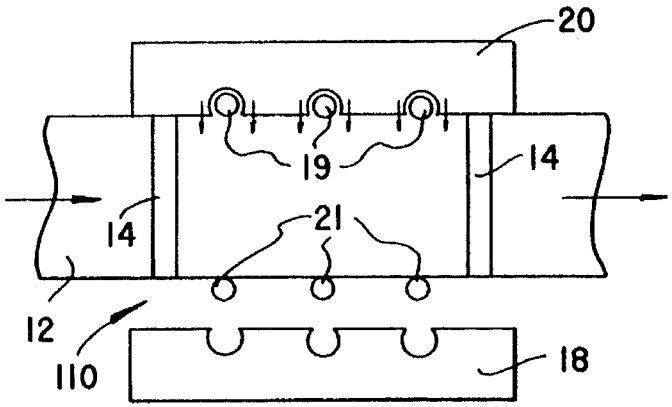
Figure 18:
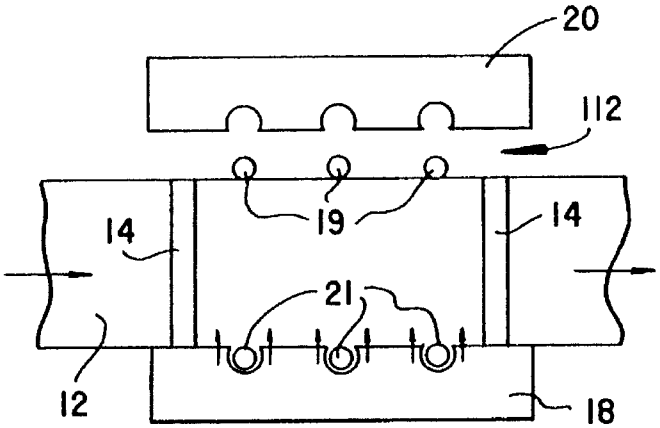
Figure 21:
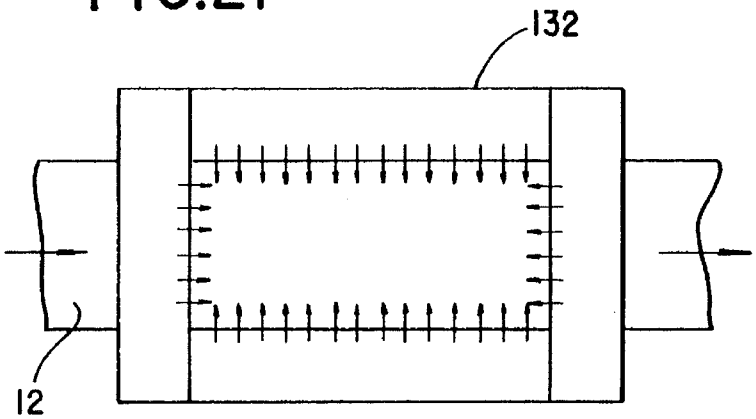
Figure 20:
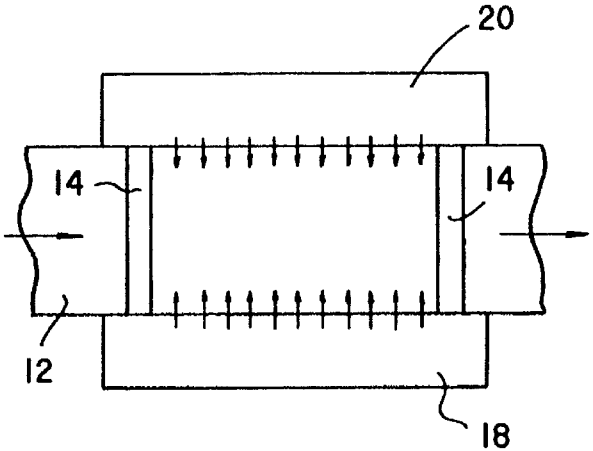
Figure 22:
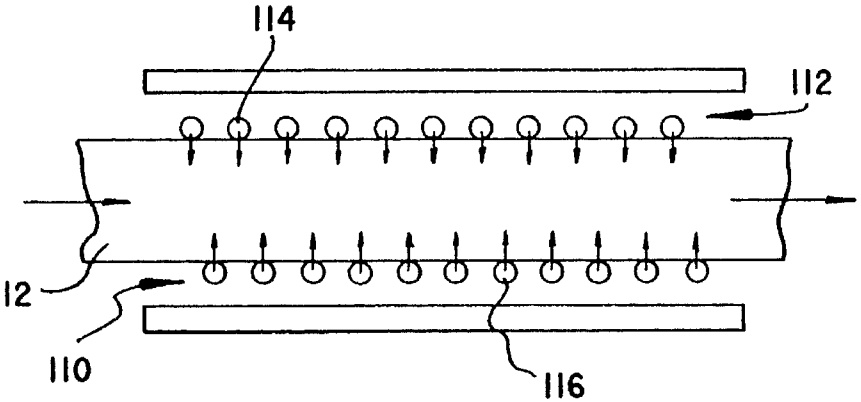

In FIGS. 18 and 19, the operation would be intermittent. Guide pins 19, 21 are fixed but manifolds 18, 20 can be moved between the two positions illustrated. In FIG. 20, the operation is intermittent. One manifold is operated to blow drying air while the other manifold is operated to exhaust air from the opposite side, using vacuum if necessary. Then the roles of the manifolds are reversed. In FIG. 21, operation would be intermittent since a ring shaped manifold 132 must be lowered over each successive stack. Flows are then applied alternately to the side and end surfaces in the manner of the embodiment of FIG. 20. In FIG. 22, operation is intermittent. Slotted, hollow pins 114, 116 are staggered opposite each other to alternately blow air toward or exhaust air from a stationary stack.

Parts List

10 . . . schematic apparatus of invention
12 . . . conveyor
14 . . . flights or paddles on 12
16 . . . pack or stack of sheets to be dried
l . . . length of 16
w . . . width of 16
h . . . height of 16
18 . . . right side air manifold
19 . . . guide pins or blocks
20 . . . left side air manifold
21 . . . guide pins or blocks
22 . . . source of compressed air
23 . . . control valve
24 . . . slits from interiors of 18, 20
26 . . . compression roller
27 . . . controller for 12, 23, 26
28 . . . fluffed or expanded packs or stacks of sheets
30 . . . box frame
32 . . . legs for 30
34 . . . infeed sprockets (3) for 12
36 . . . outfeed sprockets (3) for 12
38, 40 . . . sprockets
42 . . . support conveyor for flights 14
44 . . . left side wall
46 . . . right side wall
48 . . . upstream cover plate
50 . . . downstream cover plate
51 . . . spacer block
52 . . . stiffener ribs on 48, 50
53 . . . retainer strip
54 . . . air baffle plate
56 . . . elongated apertures in 54
58 . . . side plate
60 . . . ports for air entrance through 58
62 . . . side plate
64 . . . ports for air entrance through 62
66 . . . air baffle plate
68 . . . elongated apertures in 66
70, 72 . . . extensions of 58, 66
74 . . . raised cover
76 . . . elongated rectangular body
78 . . . interior plenums in 76
80 . . . interior walls in 76
82 . . . cover plate
84 . . . openings through 82 into 78
86 . . . air exhaust slits from 78
90, 92 . . . support plates
94 . . . roller bracket (2)
96 . . . pivot arm (2)
98 . . . pneumatic cylinder (2)
102 . . . cylinder bracket (2)
104 . . . pneumatic cylinder (2)
106 . . . lifter finger (2)
110, 112 . . . flow areas for air leaving fluffed stacks 28
114, 116 . . . hollow, slotted pins
118, 120 . . . guide surfaces
122 . . . movable hood
124, 126 . . . recesses for 19, 21
128, 130 . . . exhaust slots for air leaving fluffed stacks 28
132 . . . ring shaped manifold While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A method for drying a freely expandable stack of sheet material, the freely expandable stack having a width, a length, a height, first and second opposite sides separated by the width to which sides opposite side edges of each sheet extend, and a front side and a rear side separated by the length, comprising steps of:

directing a first flow of drying gas against the edges substantially along the length and height of the first side of said stack of sheet material to cause said stack to expand in the height dimension and concurrently suspending each sheet offspaced from adjacent sheets on a gas cushion, and thereby allowing the drying gas to flow between the sheets across the width toward the second side to effect moisture transfer from the sheets to the drying gas;

directing a second flow of drying gas against the edges substantially along the length and height of the second side of said stack to expand in the height dimension and concurrently suspending each sheet offspaced from adjacent sheets on a gas cushion, and to cause the drying gas to flow between the sheets across the width toward the first side to effect moisture transfer from the sheets to the drying gas;

terminating the first flow prior to terminating the second flow; and terminating the second flow.

2. A method according to claim 1, further comprising the step of impeding flow of the drying gas from the front and rear sides during the directing steps.

3. A method according to claim 1, further comprising the step of compressing the stack after terminating the second flow to expel drying gas from between the sheets.

4. A method according to claim 1, wherein terminating the first flow occurs prior to directing the second flow.

5. A method according to claim 1, further comprising the step of conveying the stack along a path during the steps of directing.

6. A method according to claim 1, further comprising the steps of terminating the first flow prior to directing the second flow; impeding flow of the drying gas from the front and rear sides during the directing steps; conveying the stack along a path during the steps of directing; and compressing the stack after terminating the second flow to expel drying gas from between the sheets.

7. A method according to claim 1, further comprising the steps of terminating the first flow prior to directing the second flow; impeding flow of the drying gas from the front and rear sides during the directing steps; and conveying the stack along a path during the steps of directing.

8. A method according to claim 1 further comprising the steps of terminating the first flow prior to directing the second flow; impeding flow of the drying gas from the front and rear sides during the directing steps; and compressing the stack after terminating the second flow to expel drying gas from between the sheets.

9. A method according to claim 1, further comprising the steps of impeding flow of the drying gas from the front and rear sides during the directing steps; conveying the stack along a path during the steps of directing; and compressing the stack after terminating the second flow to expel drying gas from between the sheets.

10. A method according to claim 1, further comprising the steps of terminating the first flow prior to directing the second flow; conveying the stack along a path during the steps of directing; and compressing the stack after terminating the second flow to expel drying gas from between the sheets.

11. A method according to claim 1, further comprising the steps of terminating the first flow prior to directing the second flow; and impeding flow of the drying gas from the front and rear sides during the directing steps.

12. A method according to claim 1, further comprising the steps of terminating the first flow prior to directing the second flow; and conveying the stack along a path during the steps of directing.

13. A method according to claim 1, further comprising the steps of terminating the first flow prior to directing the second flow; and compressing the stack after terminating the second flow to expel drying gas from between the sheets.

14. A method according to claim 1, further comprising the steps of impeding flow of the drying gas from the front and rear sides during the directing steps; and conveying the stack along a path during the steps of directing.

15. A method according to claim 1, further comprising the steps of impeding flow of the drying gas from the front and rear sides during the directing steps; and compressing the stack after terminating the second flow to expel drying gas from between the sheets.

16. Apparatus for drying a freely expandable stack of sheet material, the freely expandable stack having a width, a length, a height, first and second opposite sides separated by the width to which sides opposite side edges of each sheet extend, and a front side and a rear side separated by the length, comprising:

a source of drying gas;

a first flow guide member connected to the source to direct a first flow of drying gas against the edges substantially along the length and height of the first side of said stack of sheet material to cause said stack to expand in the height dimension and concurrently suspending each sheet offspaced from adjacent sheets on a gas cushion, and thereby allowing the drying gas to flow between the sheets across the width toward the second side to effect moisture transfer from the sheets to the drying gas;

a second flow guide member connected to the source to direct a second flow of drying gas against the edges substantially along the length and height of the second side of said stack of sheet material to cause said stack to expand in the height dimension and concurrently suspending each sheet offspaced from adjacent sheets on a gas cushion, and thereby allowing the drying gas to flow between the sheets across the width toward the first side to effect moisture transfer from the sheets to the drying gas;

means for terminating the first flow prior to terminating the second flow; and means for terminating the second flow.

17. Apparatus according to claim 16, further comprising baffles for impeding flow of the drying gas from the front and rear sides.

18. Apparatus according to claim 16, further comprising means for compressing the stack after terminating the second flow to expel drying gas from between the sheets.

19. Apparatus according to claim 16, wherein terminating the first flow occurs prior to directing the second flow.

20. Apparatus according to claim 16, further comprising a conveyor for moving the stack along a path between the first and second flow guide members.

21. Apparatus according to claim 16, further comprising an enclosure for surrounding the first and second flow guide members and a stack being dried.

22. Apparatus according to claim 16, wherein terminating the first flow occurs prior to directing the second flow, further comprising baffles for impeding flow of the drying gas from the front and rear sides; means for compressing the stack after terminating the second flow to expel drying gas from between the sheets; a conveyor for moving the stack along a path between the first and second flow guide members; and an enclosure for surrounding the first and second flow guide members and a stack being dried.

23. Apparatus according to claim 16, wherein terminating the first flow occurs prior to directing the second flow, further comprising baffles for impeding flow of the drying gas from the front and rear sides; means for compressing the stack after terminating the second flow to expel drying gas from between the sheets; and a conveyor for moving the stack along a path between the first and second flow guide members.

24. Apparatus according to claim 16, further comprising baffles for impeding flow of the drying gas from the front and rear sides; means for compressing the stack after terminating the second flow to expel drying gas from between the sheets; a conveyor for moving the stack along a path between the first and second flow guide members; and an enclosure for surrounding the first and second flow guide members and a stack being dried.

25. Apparatus according to claim 16, wherein terminating the first flow occurs prior to directing the second flow, further comprising means for compressing the stack after terminating the second flow to expel drying gas from between the sheets; a conveyor for moving the stack along a path between the first and second flow guide members; and an enclosure for surrounding the first and second flow guide members and a stack being dried.

26. Apparatus according to claim 16, wherein terminating the first flow occurs prior to directing the second flow, further comprising baffles for impeding flow of the drying gas from the front and rear sides; means for compressing the stack after terminating the second flow to expel drying gas from between the sheets; and an enclosure for surrounding the first and second flow guide members and a stack being dried.

27. Apparatus according to claim 16, wherein terminating the first flow occurs prior to directing the second flow, further comprising baffles for impeding flow of the drying gas from the front and rear sides; a conveyor for moving the stack along a path between the first and second flow guide members; and an enclosure for surrounding the first and second flow guide members and a stack being dried.

28. Apparatus according to claim 16, wherein terminating the first flow occurs prior to directing the second flow, further comprising baffles for impeding flow of the drying gas from the front and rear sides; and means for compressing the stack after terminating the second flow to expel drying gas from between the sheets.

29. Apparatus according to claim 16, wherein terminating the first flow occurs prior to directing the second flow, further comprising baffles for impeding flow of the drying gas from the front and rear sides; and a conveyor for moving the stack along a path between the first and second flow guide members.

30. Apparatus according to claim 16, wherein terminating the first flow occurs prior to directing the second flow, further comprising baffles for impeding flow of the drying gas from the front and rear sides; and an enclosure for surrounding the first and second flow guide members and a stack being dried.

31. Apparatus according to claim 16, further comprising baffles for impeding flow of the drying gas from the front and rear sides; means for compressing the stack after terminating the second flow to expel drying gas from between the sheets; and a conveyor for moving the stack along a path between the first and second flow guide members.

32. Apparatus according to claim 16, further comprising baffles for impeding flow of the drying gas from the front and rear sides; means for compressing the stack after terminating the second flow to expel drying gas from between the sheets; and an enclosure for surrounding the first and second flow guide members and a stack being dried.

33. Apparatus according to claim 16, wherein terminating the first flow occurs prior to directing the second flow, further comprising means for compressing the stack after terminating the second flow to expel drying gas from between the sheets; and a conveyor for moving the stack along a path between the first and second flow guide members.

34. Apparatus according to claim 16, wherein terminating the first flow occurs prior to directing the second flow, further comprising means for compressing the stack after terminating the second flow to expel drying gas from between the sheets; and an enclosure for surrounding the first and second flow guide members and a stack being dried.

35. Apparatus according to claim 16, wherein terminating the first flow occurs prior to directing the second flow, further comprising a conveyor for moving the stack along a path between the first and second flow guide members; and an enclosure for surrounding the first and second flow guide members and a stack being dried.

36. Apparatus according to claim 16, further comprising baffles for impeding flow of the drying gas from the front and rear sides; a conveyor for moving the stack along a path between the first and second flow guide members; and an enclosure for surrounding the first and second flow guide members and a stack being dried.

37. Apparatus according to claim 16, further comprising means for compressing the stack after terminating the second flow to expel drying gas from between the sheets; a conveyor for moving the stack along a path between the first and second flow guide members; and an enclosure for surrounding the first and second flow guide members and a stack being dried.

* * * * *